US006127027A

United States Patent [19]

Nogami et al.

[11] Patent Number: 6,127,027

[45] Date of Patent: Oct. 3, 2000

[54] FABRIC FOR PLANT LIFE

[75] Inventors: Yoshihiro Nogami; Mituko Yosie; Yasuei Yamamoto, all of Fukui; Kenji Hiramatsu, Osaka, all of Japan

[73] Assignees: Kuraray Co., Ltd., Kurashiki; Urase Co., Ltd., Sabae, both of Japan

[21] Appl. No.: 08/939,008

[22] Filed: Sep. 26, 1997

[30] Foreign Application Priority Data

Sep. 27, 1996 [JP] Japan ..... 8-275254

[51] Int. Cl.[7] ..... B32B 5/16

[52] U.S. Cl. ..... 428/220; 428/913; 442/118; 442/164; 442/414; 442/417; 442/149; 47/48.5

[58] Field of Search ..... 442/118, 164, 442/417, 414, 149; 428/913, 220; 47/48.5

[56] References Cited

U.S. PATENT DOCUMENTS 5,432,000 7/1995 Young, Sr. et al. ..... 428/372
5,763,067 6/1998 Bruggemann et al. ..... 428/317.9

FOREIGN PATENT DOCUMENTS 0 475 489 3/1992 European Pat. Off. .

OTHER PUBLICATIONS

Patent Abstracts of Japan, vol. 009, No. 071 (C–272), Mar. 30, 1985, JP 59 204680, Nov. 20, 1984.
Patent Abstracts of Japan, vol. 016, No. 212 (M–1250), May 19, 1992, JP 04 035933, Feb. 6, 1992.
Patent Abstracts of Japan, vol. 014, No. 404 (M–1018), Aug. 31, 1990. JP 02 153731, Jun. 13, 1990.
Patent Abstracts of Japan, vol. 018, No. 012 (C–1150), Jan. 11, 1994, JP 05 247777, Sep. 24, 1993.
Patent Abstracts of Japan, vol. 096, No. 012, Dec. 26, 1996, JP 08 218275, Aug. 27, 1996.

*Primary Examiner*—Elizabeth M. Cole
*Attorney, Agent, or Firm*—Oblon, Spivak, McClelland, Maier & Neustadt, P.C.

[57] ABSTRACT

A fabric for plant life contains fibrous material which contains not less than 5% by weight of an organic polymer fiber having a fineness of not less than 30 deniers, a moisture-absorbent polymer; and a binder polymer, the moisture-absorbent polymer and the binder polymer being adhered to the fibrous material. The fabric has a water absorption per volume of from 0.02 to 10 g water/cm$^3$, shows an apparent density of from 0.001 to 0.3 g/cm$^3$ under elevated pressure of 20 g/cm$^2$ and has a thickness of not less than 1.5 mm under elevated pressure of 20 g/cm$^2$.

20 Claims, 2 Drawing Sheets

FABRIC FOR PLANT LIFE

BACKGROUND OF THE INVENTION

1. Field of the Invention

This invention relates to a fabric for plant life and a method for raising plants by using the same. More particularly, the present invention relates to a fabric for plant life which can be efficiently employed in raising plants in, for example, areas with little rainfall (deserts, etc.), areas where considerable labor and a long time are needed for feeding water (golf courses, soccer stadiums, baseball grounds, median strips, etc.) and areas where rainwater can be scarcely retained in the ground (slopes in mountains or residential land, etc.), as well as a method for raising plants by using this fabric for plant life.

2. Description of the Related Art

It has been required to elevate the water retention in soil, relieve the labor for feeding plants with water and reduce the feeding water in, for example, areas where plants can hardly grow because of little rainfall (deserts, etc.), areas where plants can hardly grow because of a lack of soil (rocks, etc.), and areas where considerable labor and a long time are needed for feeding water (golf courses, soccer stadiums, baseball grounds, median strips, etc.).

The conventional techniques aiming at elevating moisture retention include greening sheets consisting of porous sheets (net, woven fabric, etc.) and moisture-absorbent polymers adhered thereto (JP-A-2-16216; the term "JP-A" as used herein means an "Unexamined Japanese Patent Publication"); knit mesh sheets consisting of moisture-absorbent fibers (JP-A-5-247777); and moisture-absorbent woven fabrics in which water-absorbent polymers are adhered to woven structures (JP-A-8-218275). However, these conventional greening sheets and knit mesh sheets generally fail to retain a sufficient volume of moisture needed for raising plants due to insufficient thickness (1 mm or less). When made of thin fibers, such a sheet undergoes compressive deformation under soil pressure and thus loses its voids which are necessary in sustaining moisture retention characteristics and appropriate drainage characteristics and for the growth of plant roots. As a result, there arise withering due to a shortage of water, root rot due to excessive water content, salinization caused by accumulated salts, insufficient growth caused by close rooting, etc.

In the above-mentioned conventional techniques, moreover, no particular discussion is made on the moisture absorbing capacity (moisture absorption), etc. required for the normal growth of plants.

In areas with extremely little rainfall such as deserts, it has been a practice to use desalinated seawater as feeding water. However, a small amount of salt still remains in the desalinated seawater. To raise plants under these circumstances, it is therefore necessary to use a moisture-absorbent material which has a high moisture absorbing capacity. It is also needed that the salt remaining in water is scarcely accumulated in the moisture-absorbent material and, if accumulated, can be easily washed away therefrom. However, these points are never considered in the conventional greening sheets and moisture-absorbent fabrics described above.

In addition to the high moisture absorbing capacity, the prevention of salt accumulation and easiness in washing away salts as described above, it is an important factor of a moisture-absorbent material for greening to have appropriate drainage characteristics, from the viewpoint of preventing root rot due to excessive moisture content. Furthermore, a greening sheet should be provided with voids allowing the healthy growth of plant roots. With respect to these points, however, no sufficient consideration is given in the conventional greening sheets and moisture-absorbent fabrics described above.

SUMMARY OF THE INVENTION

An object of the present invention is to provide a material for use with plant life which has good moisture retention characteristics, appropriate drainage characteristics and voids suitable for the growth of plant roots and makes it possible to raise plants while sufficiently retaining moisture in the soil and thus causing no withering due to a shortage of moisture, when used in, for example, areas with little rainfall (deserts, etc.), areas where rainwater can be scarcely retained in the ground (slopes, etc.), and areas where considerable labor and a long time are needed for feeding water (golf courses, soccer stadiums, baseball grounds, median strips, etc.).

Another object of the present invention is to provide a method for rasing plants by using the above-mentioned material for use with plant life.

The present inventors have conducted extensive studies to achieve the above-mentioned objects. As a result, they have successfully found out that when a fabric for plant life containing a definite amount or more of an organic polymer fiber having a fineness of at least 30 dr (denier), showing an apparent density of from 0.001 to 0.3 g/cm$^3$ under elevated pressure of 20 g/cm$^2$, having a thickness of at least 1.5 mm under elevated pressure of 20 g/cm$^2$, and having a moisture-absorbent polymer having a water absorption capacity regulated to a definite level adhered thereto, the fabric for plant life has an appropriate rigidity. Therefore, when laid underground, it is not completely crushed under the soil pressure but can sustain appropriate voids therein and maintain good moisture retention characteristics and appropriate drainage characteristics, thus allowing sufficient water feeding and ensuring the healthy growth of plants while causing neither withering due to a shortage of moisture, root rot due to excessive moisture content nor salinization due to accumulated salts.

Accordingly, the present invention provides a fabric for plant life containing at least 5% by weight of an organic polymer fiber having a fineness of at least 30 dr, showing an apparent density of from 0.001 to 0.3 g/cm$^3$ under elevated pressure of 20 g/cm$^2$ and having a thickness of at least 1.5 mm under elevated pressure of 20 g/cm$^2$, wherein a moisture-absorbent polymer and a binder polymer are adhered to the fiber constituting said fabric and said fabric has a moisture absorption per volume of from 0.02 to 10 g water/cm$^3$.

The present invention further provides a method for raising plants by using the above-mentioned fabric for plant life.

DETAILED DESCRIPTION OF THE INVENTION

Figure 1:
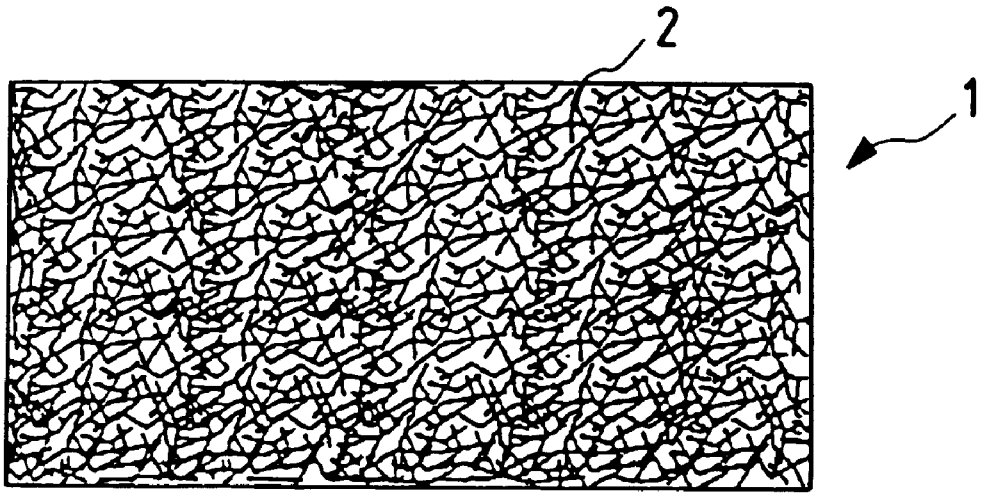
FIG. 1 is a diagram showing a nonwoven fabric to be used in the fabric for plant life of the present invention observed from one surface thereof.

Now, the present invention will be described in detail.

First, the fabric for plant life of the present invention should contain at least 5% by weight, preferably at least 20% by weight and still preferably 50 to 100% by weight, based on the total weight of the fibers constituting the fabric for plant life, of an organic polymer fiber having a fineness of at least 30 dr (hereinafter sometimes referred to as "thick organic polymer fiber").

When the content of the organic polymer fiber having a fineness of at least 30 dr in the fabric for plant life is less than 5% by weight, the fabric for plant life undergoes compressive deformation under soil pressure, when laid underground. Thus voids therein which are necessary in moisture retention and appropriate drainage and for the growth of plant roots are lost. As a result, there arise troubles such as withering due to a shortage of moisture, root rot due to excessive moisture content, salinization caused by accumulated salts, insufficient growth caused by close rooting, etc.

The fineness of the thick organic polymer fiber to be used in the fabric for plant life of the present invention is not particularly restricted, so long as it is at least 30 dr. However, it is preferable that the fabric for plant life of the present invention contains at least 5% by weight of a thick organic polymer fiber having a fineness of at least 50 dr, still preferably at least 100 dr. Thus, an elevated compression resistance can be imparted to the fabric for plant life and the deformation of the fabric for plant life under soil pressure can be relieved, when laid underground.

Generally speaking, the rigidity of the fabric for plant life is elevated and the deformation under soil pressure can be relieved with an increase in the fineness of the thick organic polymer fiber and with an increase in the content thereof, though these phenomena vary depending on the type of the organic polymer fiber.

Although there is no particular upper limit of the fineness of the thick organic polymer fiber, an excessively large fineness of the organic polymer fiber makes it difficult to produce a fabric such as a nonwoven fabric or a knit fabric. It is therefore preferable that the fineness is not more than 300 dr.

The fabric for plant life of the present invention may contain either one or more thick organic polymer fibers having a fineness of at least 30 dr.

The fibers other than the thick organic polymer fiber constituting the fabric for plant life of the present invention are not restricted in type or fineness. When fibers with a small fineness are used in a large content, however, the voids among fibers in the fabric become smaller. In such a case, it is frequently observed that appropriate drainage characteristics can be hardly achieved or close rooting inhibits the normal growth of plants. When the content of the thick organic polymer fiber is less than 50%, it is therefore preferable to use fibers having a fineness of at least 15 dr, in particular at least 20 dr, as other fibers constituting the fabric.

Furthermore, the fabric for plant life of the present invention should have an apparent density of from 0.001 to 0.3 g/cm$^3$ under elevated pressure of 20 g/cm$^2$.

When this apparent density is less than 0.001 g/cm$^3$, it is impossible to ensure the sufficient moisture retention required in the growth of plants. When the apparent density exceeds 0.3 g/cm$^3$, on the other hand, the excessive moisture retention of the fabric for plant life causes root rot or close rooting due to a lack in the space inhibits the healthy growth of plants.

It is still preferable that the fabric for plant life of the present invention has an apparent density under elevated pressure of 20 g/cm$^2$ of from 0.002 to 0.2 g/cm$^3$ from the viewpoints of moisture retention, appropriate drainage characteristics, healthy growth of roots, prevention of salinization, etc.

The expression an "apparent density under elevated pressure of 20 g/cm$^2$" as used herein means the weight (g) of the fabric for plant life per apparent unit volume (cm$^3$) thereof when the fabric for plant life is compressed downward under elevated pressure of 20 g/cm$^2$ from the upper face on which soil is to be put when it is laid underground, as will be described in greater detail in the following Examples.

When the fabric for plant life of the present invention having an apparent density of from 0.001 to 0.3 g/cm$^3$ under elevated pressure of 20 g/cm$^2$ is laid (buried) underground in a depth of, for example, 10 cm, it can sustain an apparent density comparable to the level as defined above (i.e., from 0.001 to 0.3 g/cm$^3$). Thus good moisture retention characteristics and appropriate drainage characteristics can be maintained. Moreover, the accumulation of salts can be prevented, the accumulated salts can be smoothly eliminated therefrom and the space required in the growth of roots can be hold, thus allowing the healthy growth of plants.

The fabric for plant life of the present invention should have a thickness of at least 1.5 mm, preferably at least 2 mm under the pressure of 20 g/cm$^2$. When the thickness of the fabric for plant life is less than 1.5 mm, no sufficient water retention capacity can be imparted thereto. When the fabric for plant life has a thickness less than 1.5 mm, furthermore, it may be regarded as not a stereostructure (three-dimensional structure) but a planar one (two-dimensional structure). Thus, the fabric for plant life can come in contact with plant roots not in the depth and planar directions but exclusively in the planar direction, which makes it impossible to feed the roots with sufficient water.

In view of these points, the fabric for plant life of the present invention is superior in the achievement of the effects of promoting the growth of plants to the moisture-absorbent fabrics described in JP-A-8-218275 and the greening sheets described in JP-A-2-16216 each generally having a thickness of 1 mm or less.

The upper limit of the thickness of the fabric for plant life of the present invention under the pressure of 20 g/cm$^2$ may be determined depending on the area in which it is to be laid, the environments, the plants to be raised thereon, etc. The thickness thereof is preferably less than 50 $\mu$m, still preferably less than 25 $\mu$m, more preferably less than 15 $\mu$m.

It is preferable that the fabric for plant life of the present invention has a thickness of at least 2.0 mm, still preferably at least 2.5 mm without pressure.

Further, the fabric for plant life of the present invention should have a definite moisture absorbing capacity. Moisture absorption properties may be imparted to the fabric for plant life by any method without restriction. That is, an arbitrary method may be selected therefor, so long as the fabric for plant life, to which the moisture absorption properties have been thus imparted, contains at least 5% by weight of an organic polymer fiber having a fineness of at least 30 dr, can sustain the above-mentioned apparent density (i.e., from 0.001 to 0.3 g/cm$^3$ under elevated pressure of 20 g/cm$^2$) and maintain a thickness of at least 2 mm without elevated pressure.

Typical examples of the methods for imparting moisture absorption properties to a fabric for plant life are as follows.

(i) A moisture-absorbent polymer is adhered to the organic polymer fiber constituting the fabric for plant life.

(ii) The organic polymer fiber constituting the fabric for plant life is composed of, at least partly, a moisture-absorbent organic polymer fiber.

In the present invention, use is made of a fabric for plant life wherein a moisture-absorbent polymer is adhered to an organic polymer fiber, i.e., the one of the above (i).

More particularly, the fabric for plant life is one wherein a moisture-absorbent polymer and a binder polymer are adhered to the organic polymer fiber constituting the fabric.

In the present invention, the fabric for plant life wherein a moisture-absorbent polymer and a binder polymer are adhered to the organic polymer fiber constituting the fabric can be obtained by employing a method including dissolving or dispersing the moisture-absorbent polymer and the binder polymer in water or an organic solvent and then spraying the solution or dispersion onto the fabric; a method including immersing the fabric in the above-mentioned solution or dispersion; a method including adhering a moisture-absorbent polymer and a binder polymer to the surface of the organic polymer fiber by using the above-mentioned solution or dispersion and then constructing the fabric for plant life with the use of the organic polymer fiber; etc. When a fabric for plant life is constructed after adhering a moisture-absorbent polymer to the organic polymer fiber, it is feared that the moisture-absorbent polymer might peeled off from the fiber surface in the process of the construction of the fabric. It is therefore desirable that a moisture-absorbent polymer and a binder polymer are adhered to the fabric for plant life which has been already constructed.

To further closely adhere the moisture-absorbent polymer to the organic polymer fiber or to prevent the dissolution of the moisture-absorbent polymer adhering to the organic polymer fiber into water, it is also possible, if needed, to perform a crosslinking treatment such as radiation crosslinking, heat crosslinking or chemical crosslinking to thereby further closely adhere the moisture-absorbent polymer to the organic polymer fiber.

As the organic polymer fiber constituting the fabric for plant life, use can be made of any organic polymer fiber containing at least 5% by weight of an organic polymer fiber having a fineness of at least 30 dr. Examples thereof include polyester fibers such as polyethylene terephthalate, polypropylene terephthalate, polytrimethylene terephthalate and polybutylene terephthalate; polyamide fibers such as nylon 6 and nylon 66; polyolefin fibers such as polyethylene and polypropylene; acrylic fibers; polyvinyl alcohol fibers; polyvinyl chloride fibers; polyvinylidene chloride fibers; cellulose fibers such as viscous rayon, polynosic rayon, cupra rayon and solvent-spinning rayon; and polysulfone fibers. Either one of these organic polymer fibers or a mixture thereof may be employed. Especially, the fibers containing the fabric for plant life of the present invention is preferable to use fibers not swelling when absorbing moisture or that is low level and having hydrophobic capacity. These organic polymer fibers may have either a circular or profile section.

As the moisture-absorbent polymer to be used in the present invention, it is preferable to select one which can absorb moisture of 10 to 1,000 times, preferably 30 to 1,000 times, more preferably 100 to 1,000 times as much as its own dry weight prior to the adhesion to the organic polymer fiber. Examples of such moisture-absorbent polymers include polyacrylic acid polymers, polyvinyl alcohol polymers, isobutylene/maleic anhydride copolymers, polyethylene oxide polymers, polyvinyl pyrrolidone polymers, ethylcellulose polymers, polyacrylamide and polystyrenesulfonic acid polymers. In the present invention, use can be made of either one of these moisture-absorbent polymers or a mixture of two or more thereof.

In the fabric for plant life of the present invention, it is preferable that the moisture absorbing capacity ($Q_1$) of the moisture-absorbent polymer, after the adhesion to the organic polymer fiber, is apparently reduced, due to the coexistence of the binder polymer, so as to satisfy the following formula. Thus excellent water retention characteristics and appropriate drainage characteristics can be imparted to the fabric and consequently plants can be well raised thereby.

$$0.01Q_0 \leq Q_1 \leq 0.5Q_0 \quad (1)$$

wherein $Q_0$ means the inherent moisture absorbing capacity of the moisture-absorbent polymer observed prior to the adhesion thereof to the organic polymer fiber; and $Q_1$ represents the apparent moisture absorbing capacity of the moisture-absorbent polymer observed after the adhesion thereof to the organic polymer fiber.

$Q_0$ and $Q_1$ in the above numerical formula (1) can be determined in accordance with the following numerical formulae (2) and (3).

$$Q_0 \text{ (by weight)} = Wp_1/Wp_0 \quad (2)$$

wherein $Wp_0$ means the dry weight (g) of the moisture-absorbent polymer; and $Wp_1$ means the weight (g) of the moisture-absorbent polymer measured by immersing the moisture-absorbent polymer in water at 25° C. for 1 hour, taking it out and allowing it to stand on a wire mesh for 5 minutes so as to drain excessive water off.

$$Q_1 \text{ (by weight)} = (Wa - We_0)/(We_1 - We_0) \quad (3)$$

wherein $We_0$ means the dry weight (g) of the fabric prior to the adhesion of the moisture-absorbent polymer and the binder polymer thereto; $We_1$ means the dry weight (g) of the fabric to which the moisture-absorbent polymer and binder polymer are adhered; and Wa means the weight (g) of the fabric to which the moisture-absorbent polymer and the binder polymer are adhered measured by immersing the fabric in water at 25° C. for 1 hour, taking it out and allowing it to stand on a wire mesh for 5 minutes so as to drain excessive moisture off.

When the moisture absorbing capacity ($Q_1$) of the moisture-absorbent polymer after the adhesion thereof to the organic polymer fiber is smaller than $0.01Q_1$, the fabric for plant life is poor in moisture retention characteristics and thus plants growing thereon are dead in some cases. When the above moisture absorbing capacity ($Q_1$) is larger than $0.5Q_1$, on the other hand, the moisture absorbing capacity of the fabric for plant life exceeds that of plant roots. In such a case, the moisture contained in the plant roots is frequently absorbed by the fabric contrarily and thus plants cannot grow well in some cases.

Since the fabric for plant life of the present invention is employed under extremely severe weather conditions (for example, in deserts), a polymer having a high moisture absorbing capacity per se should be selected as the one to be adhered to the organic polymer fiber. However, it is sometimes observed that such a highly moisture-absorbent polymer might contrarily absorb the moisture contained in plant roots being in contact therewith. That is to say, the high moisture absorbing capacity might bring about the undesired phenomenon. To overcome this problem, such a moisture-absorbent polymer is employed together with a binder polymer in the fabric for plant life of the present invention so that the binder polymer partly covers the moisture-absorbent polymer and thus appropriately control the moisture absorbing capacity. In the fabric for plant life of the present invention in the above-mentioned state, it is preferable from the viewpoint of the healthy growth of plants that the moisture-absorbent polymer adhering to the organic polymer fiber finally has a moisture absorbing capacity of 5 to 100 times, still preferably 10 to 50 times, as much as its own weight.

The binder polymer to be used in the present invention may be an arbitrary one, so long as it can appropriately control the high moisture absorbing capacity of the moisture-absorbent polymer and contribute to the well adhesion of the moisture-absorbent polymer to the organic polymer fiber. Namely, it may be appropriately selected depending on the organic polymer fiber and moisture-absorbent polymer to be used together. For example, use can be made therefor of urethane polymers, acrylic polymers or polyester polymers.

To adhere the moisture-absorbent polymer to the organic polymer fiber in such a manner as to satisfy the above numerical formula (1), it is preferable to use the moisture-absorbent polymer and the binder polymer at a weight ratio of from 1:3 to 10:1.

The state of the adhesion of the moisture-absorbent polymer and the binder polymer in this fabric for plant life can be confirmed by, for example, staining one of the polymers alone and observing under, for example, an optical microscope.

It is important to regulate the moisture absorbing capacity of the fabric for plant life of the present invention to 0.02 to 10 g water/cm$^3$. When the moisture absorbing capacity of the fabric for plant life falls within the range as defined above, plants can well grow therein with scarcely any troubles such as withering due to a shortage of water, root rot due to excessive water content, etc.

The moisture absorbing capacity of the fabric for plant life can be determined in accordance with the following numerical formula (4).

Moisture absorbing capacity of fabric for use with plant life $$(g/cm^3)=(W_{aq}-W_{dr})/V \quad (4)$$

wherein V means the apparent volume (cm$^3$) of the fabric for plant life under the pressure of 20 g/cm$^2$; $W_{dr}$ means the dry weight (g) of the fabric for plant life with volume V (cm$^3$); and $W_{aq}$ means the weight (g) of the fabric for plant life with volume V (cm$^3$) measured by immersing the fabric in water at 25° C. for 1 hour, taking it out and allowing it to stand on a wire mesh for 5 minutes so as to drain excessive moisture off.

The fabric for plant life of the present invention is preferably a nonwoven fabric or a knit fabric or a composite material composed of two or more thereof. From an economical viewpoint, a nonwoven fabric is preferable therefor. Although woven fabrics are not excluded from the scope of the present invention, it is generally difficult to process a woven fabric into a fabric for plant life having a thickness of at least 2 mm without elevated pressure. When the fabric for plant life of the present invention consisting of a nonwoven fabric and/or a knit fabric has a rough mesh structure as the whole or it is provided with a number of openings penetrating throughout the fabric in the direction of depth (i.e., from one surface to another surface), then the fabric for plant life has excellent moisture retention characteristics and appropriate drainage characteristics and contains voids therein allowing the healthy growth of plant roots. Thus, the plants can well grow therein with scarcely any troubles such as withering due to a shortage of moisture, root rot due to excessive moisture content, close rooting, etc.

When the fabric for plant life is made of a nonwoven fabric, voids allowing the healthy growth of plants can be formed within the fabric while maintaining excellent moisture retention characteristics and appropriate drainage characteristics by the following methods:

(a) As FIG. 1 which is a plan view of a nonwoven fabric 1 shows, the whole nonwoven fabric has a rough mesh structure having a number of openings 2 with an opening area of 0.5 to 50 mm$^2$ (i.e., voids penetrating through the nonwoven fabric in the direction of depth).

Figure 2:
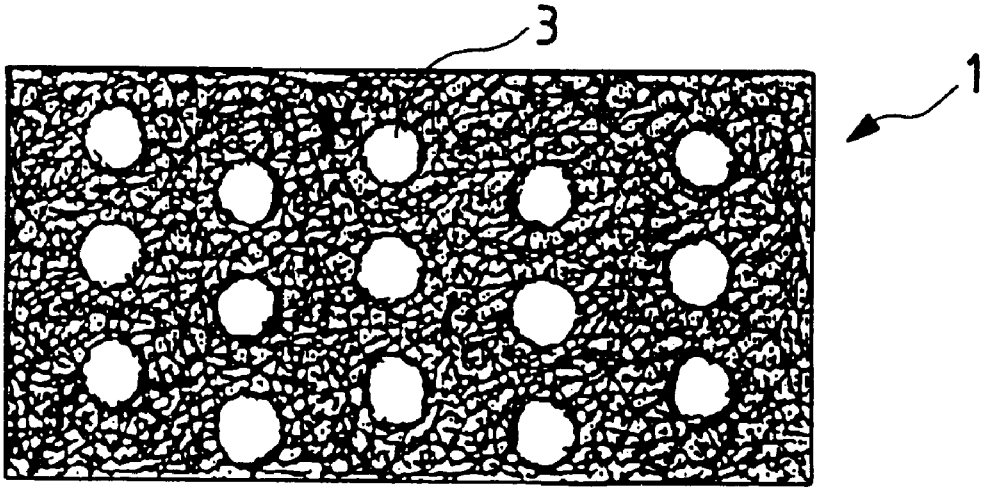
FIG. 2 is a diagram showing a nonwoven fabric to be used in the fabric for plant life of the present invention observed from another surface thereof.

(b) As FIG. 2 which is a plan view of a nonwoven fabric 1 shows, the nonwoven fabric 1 has a close net structure provided with a number of penetrating openings 3 with an opening area of 0.5 to 750 mm$^2$, i.e., pierced horizontally (in the direction of depth) during or after the construction of the nonwoven fabric.

Alternatively, the following method may be employed therefor in some cases:

(c) A fabric for plant life made of a nonwoven fabric with a rough mesh as that of (a) is pierced to thereby form penetrating openings 3 similar to the one of above (b).

In the fabric for plant life of the above (b) or (c), it is preferable to form the penetrating openings 3 at intervals of about 2 to 100 mm all over the nonwoven fabric either regularly or irregularly. These penetrating openings 3 may be in an arbitrary shape such as circular, square, triangular or polygonal ones.

In each of the above cases (a) to (c), it is preferable that the total area of the penetrating openings 2 or 3 amounts to about 8 to 90% of the area of one surface of the nonwoven fabric, when observed from one surface of the nonwoven fabric.

Figure 3:
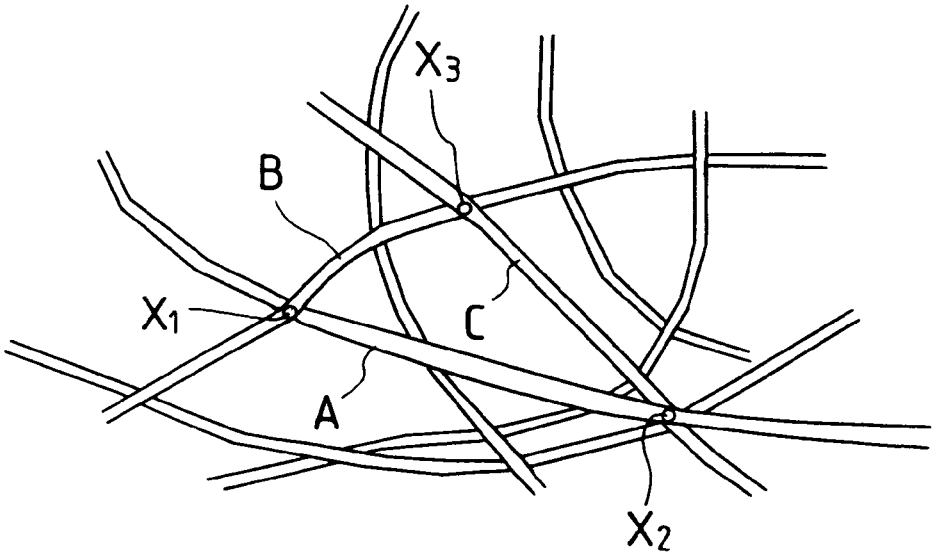
FIG. 3 is a diagram showing how to determine the fiber intersection distance in the fabric for plant life made of a nonwoven fabric.

In a fabric for plant life made of a nonwoven fabric, the point of intersection of fibers A and B is referred to as $X_1$, the point of intersection of the fiber A and another fiber C is referred to as $X_2$, the point of intersection of the fiber B and the fiber C is referred to as $X_3$ and so on, as shown in FIG. 3. Then the average of the straight linear distance between the points $X_1$ and $X_2$ ($X_1$–$X_2$), that between the points $X_2$ and $X_3$ ($X_2$–$X_3$), that between the points $X_3$ and $X_1$ ($X_3$–$X_1$) and so on is referred to as the "average fiber intersection distance". By using a nonwoven fabric having an average fiber intersection distance of from 0.2 to 4 mm, it is possible to impart good moisture retention characteristics, appropriate drainage characteristics and voids suitable for the growth of roots to the fabric for plant life.

Figure 4:
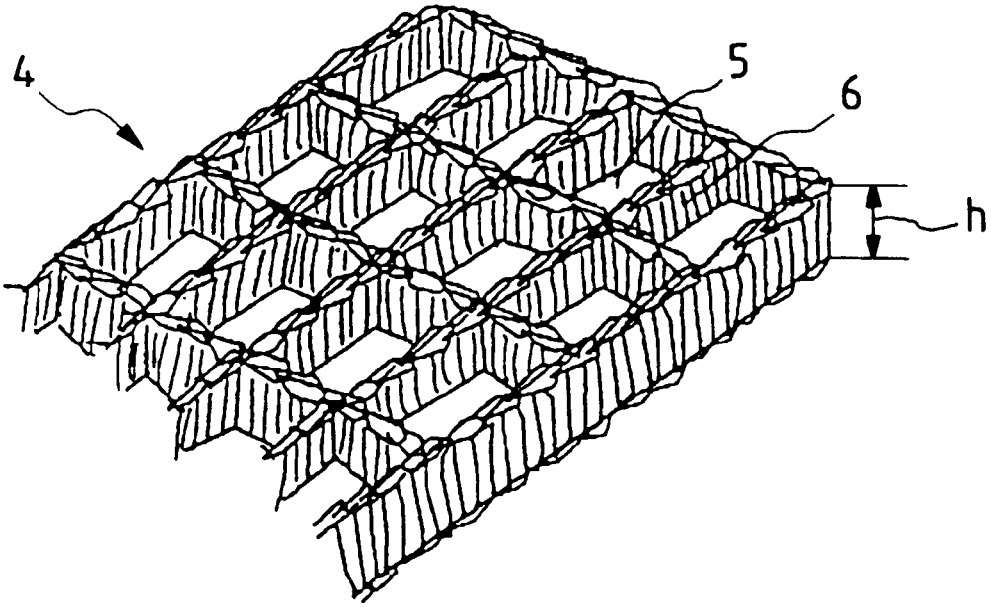
FIG. 4 is a diagram showing an example of a knit fabric usable in the fabric for plant life of the present invention.

When the fabric for plant life of the present invention is made of a knit fabric, it may have, for example, a double-raschel knit structure as shown in FIG. 4. In this case, the fabric 4 has a number of openings 5 penetrating therethrough in the direction of depth (horizontally). These openings are surrounded by walls 6 consisting of bundles of filaments and there are fine voids among these filaments in the surrounding walls. Thus the fabric for plant life can sustain excellent moisture retention characteristics and appropriate drainage characteristics and contains voids capable of promoting the growth of plant roots. Thus plants can grow well therein.

In this case, it is preferable that opening area of each penetrating opening 5 is from about 10 to 750 $mm^2$ and the total area of the penetrating openings 5 amounts to about 8 to 90% of the area of one surface of the fabric 4 (knit fabric), when observed from one surface of the fabric 4 (knit fabric).

The penetrating openings may be in an arbitrary shape such as square, triangular, diamond-shaped or polygonal ones.

It is preferable that the height (h) of the surrounding wall 6 around each penetrating opening 5 is from about 2 to 10 mm, from the viewpoints of the easiness in the production of the knit fabric, moisture retention characteristics, drainage characteristics, easiness in practice and transportation, etc.

The fabric for plant life of the present invention may have a single-layered structure consisting of the above-mentioned nonwoven fabric or knit fabric. Alternatively, it may have a laminate structure consisting of two or more layers. In the case of a laminate structure, it may consist of either the same layers laminated on each other or different ones.

If necessary, the fabric for plant life of the present invention may be laminated on other material(s) so as to improve the strength or rigidity of the fabric structure and/or to sustain or achieve the characteristic of having an apparent density of from 0.001 to 0.3 $g/cm^3$ and above mentioned specified thickness under elevated pressure of 20 $g/cm^2$ as described above.

When the fabric for plant life of the present invention is to be used in planting, the area, location, environment, etc. may be appropriately selected. In particular, it is preferably employed in deserts, golf courses, soccer stadiums, baseball grounds, median strips, lands developed for housing lots, slope, etc. However, the area where the fabric for plant life of the present invention is to be used is not restricted thereto. It may be used in other areas or environments with plant life such as gardens, parks, fields, orchards, flower beds or riverside. In some cases, it can be also employed for raising potted plants. Similarly, the type of the plants thus raised is not particularly restricted. Namely, the fabric for plant life of the present invention is usable in raising turf, vegetables, fruits, cereal plants such as wheat or barley, flowers, trees, ornamental plants, plants for preventing landslide, etc.

To grow plants by using the fabric for plant life of the present invention, it is preferable that the fabric for plant life is first buried in soil in a depth of about 3 to 20 cm, preferably about 5 to 15 cm. Alternatively the fabric for plant life of the present invention is laid on the ground and then soil is placed thereon to give a thickness of about 3 to 20 cm, preferably about 5 to 15 cm, followed by planting. In such a case, the fabric for plant life undergoes little compressive deformation due to the weight of the soil and, therefore, can sustain an apparent density falling within the range as defined above (i.e., from 0.001 to 0.3 $g/cm^3$) or therearound. Also, it can sustain a thickness of at least 2 mm or therearound without elevated pressure (at least 1.5 mm under the pressure of 20 $g/cm^2$). Thus, the fabric for plant life can maintain excellent moisture retention characteristics and appropriate drainage characteristics, the accumulation of salts therein can be prevented and the salts accumulated therein, if any, can be smoothly eliminated. In addition, the fabric for plant life can involve spaces (voids) suitable for the growth of roots, which allows the healthy growth of the plants.

Sowing and transplantation of the plants, water feeding, etc. may be performed by methods appropriately selected depending on, for example, the type of the plants and the environments.

EXAMPLES

To further illustrate the present invention in greater detail, and not by way of limitation, the following Examples will be given. In these Examples, the moisture absorbing capacity of moisture-absorbent polymer before the adhesion thereof to an organic polymer fiber constituting a fabric for plant life, the moisture absorbing capacity thereof after the adhesion and the moisture absorbing capacity of a fabric for plant life per unit volume were determined each by the method as described above. On the other hand, the apparent density of a fabric for plant life under elevated pressure of 20 $g/cm^2$, the opening area of penetrating openings in a fabric for plant life, the average fiber intersection distance of a fabric for plant life made of a nonwoven fabric and the height of the surrounding walls around penetrating openings in a fabric for plant life made of a knit fabric were each measured in the following manner.

Apparent Density of Fabric for Plant Life Under Elevated Pressure of 20 $g/cm^2$ (1) A fabric for plant life is cut into a square test piece (50 cm×50 cm) and weighed (W:g).

(2) A transparent plastic board is put on the test piece which is then compressed under pressure of 20 $g/cm^2$ including the weight of the plastic board per se. After measuring the thickness (d:cm) of the test piece, the apparent density of the fabric for plant life under elevated pressure of 20 $g/cm^2$ is determined in accordance with the following formula.

Apparent density ($g/cm^3$) of fabric for plant life under elevated pressure of $$20\ g/cm^2 = W/(50\times 50\times d) \quad (5)$$

Opening Area of Penetrating Openings in Fabric for Plant Life

In the case of a fabric for plant life having large penetrating openings (pierced ones, knit fabric, etc.), the side or diameter of an opening is measured with calipers and thus the opening area of the penetrating openings is determined.

In the case of a fabric for plant life made of a nonwoven fabric in which penetrating openings are formed by the nonwoven structure per se, an enlarged photograph (50× magnification) of the surface of the fabric is taken under a scanning electron microscope. Then the side or diameter of an opening is measured from the photograph and thus the opening area of the penetrating openings in the fabric for plant life is determined.

Average Intersection Distance of Fabric for Plant Life Made of Nonwoven Fabric

An enlarged photograph (50× magnification) of the surface of a fabric for plant life made of a nonwoven fabric is taken under a scanning electron microscope. Then each fiber intersection distance is measured and the average is calculated.

Height of Surrounding Wall Around Penetrating Opening of Fabric for Plant Life Made of Knit Fabric The height of the surrounding walls is measured in practice with calipers.

Example 1

(1) A nonwoven fabric was produced by using a polyester fiber having a fineness of 100 dr (diameter: 100 $\mu$m) and a fiber length of 70 mm by the needle-punching method in a conventional manner. To improve the strength of the nonwoven fabric, an acrylic resin (DICNARL E-7500, manufactured by DAINIPPON INK & CHEMICALS INC.) was adhered thereto at a ratio of 5% by weight based on the fiber weight to thereby give an acrylic resin-treated nonwoven fabric with a Metsuke of 130 g/m$^2$.

(2) A moisture-absorbent polymer solution was prepared by mixing 40 parts by weight of poly(sodium acrylate) having a moisture absorbing capacity $Q_0$ of 140 times as much as its dry weight (a moisture-absorbent polymer; ACRYHOPE HG-1, manufactured by NIPPON SHOKUBAI CO., LTD.), 100 parts by weight of an urethane polymer (a binder polymer; CRISVON 3314, manufactured by DAINIPPON INK & CHEMICALS INC., solid content: 20% by weight) and 300 parts by weight of isopropyl alcohol. Then the acrylic resin-treated nonwoven fabric produced in the above (1) was immersed in this moisture-absorbent polymer solution. After taking out, the nonwoven fabric was squeezed under squeezing pressure of 2 kg·f/cm$^2$ to thereby eliminate the excessive moisture-absorbent polymer solution therefrom and dried at 120° C. to thereby give a fabric for plant life made of the nonwoven fabric with a Metsuke of 300 g/m$^2$ to which 170 g/m$^2$ in total of the moisture-absorbent polymer and the binder polymer had been adhered. This fabric for plant life had a thickness of 4.2 mm.

(3) When measured by the method as specified above, the moisture-absorbent fabric for plant life made of the nonwoven fabric obtained above showed an apparent density under elevated pressure of 20 g/cm$^2$ of 0.081 g/cm$^3$. The thickness of the fabric for plant life under elevated pressure of 20 g/cm$^2$ was 3.7 mm. The moisture absorbing capacity of the fabric for plant life was 1.4 g water/cm$^3$. Further, the moisture absorbing capacity $Q_1$ of the moisture-absorbent polymer after the adhesion to the fiber determined by the above-mentioned method was $0.05Q_0$. The opening areas of the penetrating openings due to the nonwoven texture ranged from about 0.8 to 6.3 mm$^2$ and the average fiber intersection distance thereof was 1.2 mm.

Example 2

(1) A nonwoven fabric was produced by blending 70 parts by weight of a polyester fiber having a fineness of 100 dr (diameter: 100 $\mu$m) and a fiber length of 64 mm and 30 parts by weight of another polyester fiber having a fineness of 20 dr (diameter: 45 $\mu$m) and a fiber length of 64 mm and processing the blend by the needle-punching method in a conventional manner. To improve the strength of the nonwoven fabric, the same acrylic resin as the one employed in Example 1 was adhered thereto at a ratio of 5% by weight based on the fiber weight to thereby give an acrylic resin-treated nonwoven fabric with a Metsuke of 150 g/m$^2$.

(2) A moisture-absorbent polymer solution was prepared by mixing 50 parts by weight of a polyacrylic acid resin having a moisture absorbing capacity $Q_0$ of 286 times as much as its dry weight (a moisture-absorbent polymer; SANWET IM-1000, manufactured by SANYO CHEMICALS INDUSTRIES, LTD.) and 250 parts by weight of an urethane polymer (a binder polymer; CRISVON 3314, manufactured by DAINIPPON INK & CHEMICALS INC., solid content: 20% by weight). Then this moisture-absorbent polymer solution was adhered to the acrylic resin-treated nonwoven fabric produced in the above (1) by spraying thereto and dried at 120° C. to thereby give a fabric for plant life made of the nonwoven fabric with a Metsuke of 300 g/m$^2$ to which 150 g/m$^2$ in total of the moisture-absorbent polymer and the binder polymer had been adhered. This fabric for plant life had a thickness of 3.0 mm.

(3) Next, the moisture-absorbent fabric for plant life made of the nonwoven fabric obtained in the above (2) was pierced to thereby form penetrating openings of 10 mm in diameter (opening area: about 79 mm$^2$) at a ratio of 25 openings/100 cm$^2$ (the ratio of the total opening area: 20%, the minimum distance between adjacent openings: 5 mm) to thereby give a fabric for plant life.

(4) When measured by the method as specified above, the fabric for plant life obtained in the above (3) showed an apparent density under elevated pressure of 20 g/cm$^2$ of 0.12 g/cm$^3$. The thickness of the fabric for plant life under elevated pressure of 20 g/cm$^2$ was 2.5 mm. The moisture absorbing capacity of the fabric for plant life was 2.0 g water/cm$^3$. Further, the moisture absorbing capacity $Q_1$ of the moisture-absorbent polymer after the adhesion to the fiber determined by the above-mentioned method was $0.08Q_0$. The average fiber intersection distance thereof was 0.3 mm.

Example 3

(1) A nonwoven fabric was produced by blending 50 parts by weight of a polyester fiber having a fineness of 35 dr (diameter: 60 $\mu$m) and a fiber length of 64 mm and 50 parts by weight of another polyester fiber having a fineness of 25 dr (diameter: 51 $\mu$m) and a fiber length of 64 mm and processing the thus obtained blend by the needle-punching method in a conventional manner. To improve the strength of the nonwoven fabric, the same acrylic resin as the one employed in Example 1 was adhered thereto at a ratio of 3% by weight based on the fiber weight to thereby give an acrylic resin-treated nonwoven fabric with a Metsuke of 100 g/m$^2$.

(2) Then, the same moisture-absorbent polymer solution as the one employed in Example 2 was adhered to the acrylic resin-treated nonwoven fabric produced in the above (1) by spraying thereto and dried at 120° C. to thereby give a fabric for plant life made of the nonwoven fabric with a Metsuke of 150 g/m$^2$ to which 50 g/m$^2$ in total of the moisture-absorbent polymer and the binder polymer had been adhered. This fabric for plant life had a thickness of 8 mm.

(3) Next, the moisture-absorbent fabric for plant life made of the nonwoven fabric obtained in the above (2) was pierced to thereby form penetrating openings of 8 mm in diameter (opening area: about 51 mm$^2$) at a ratio of 25 openings/100 cm$^2$ (the ratio of the total opening area: 12.5%, the minimum distance between adjacent openings: 10 mm) to thereby give a fabric for plant life.

(4) When measured by the method as specified above, the fabric for plant life obtained in the above (3) showed an apparent density under elevated pressure of 20 g/cm$^2$ of 0.03 g/cm$^3$. The thickness of the fabric for plant life under elevated pressure of 20 g/cm$^2$ was 5 mm. The moisture absorbing capacity of the fabric for plant life was 0.5 g water/cm$^3$. Further, the moisture absorbing capacity $Q_1$ of the moisture-absorbent polymer after the adhesion to the fiber determined by the above-mentioned method was $0.35Q_0$. The average fiber intersection distance thereof was 3.5 mm.

Example 4

(1) A nonwoven fabric was produced by blending 20 parts by weight of a polyester fiber having a fineness of 200 dr (diameter: 143 μm) and a fiber length of 64 mm and 80 parts by weight of another polyester fiber having a fineness of 25 dr (diameter: 51 μm) and a fiber length of 64 mm and processing the blend by the needle-punching method in a conventional manner. To improve the strength of the nonwoven fabric, the same acrylic resin as the one employed in Example 1 was adhered thereto at a ratio of 5% by weight based on the fiber weight to thereby give an acrylic resin-treated nonwoven fabric with a Metsuke of 200 g/m$^2$.

(2) Then, the same moisture-absorbent polymer solution as the one employed in Example 2 was adhered to the acrylic resin-treated nonwoven fabric produced in the above (1) by spraying thereto and dried at 120° C. to thereby give a fabric for plant life made of the nonwoven fabric with a Metsuke of 600 g/m$^2$ to which 400 g/m$^2$ in total of the moisture-absorbent polymer and the binder polymer had been adhered. This fabric for plant life had a thickness of 2.5 mm.

(3) Next, the moisture-absorbent fabric for plant life made of the nonwoven fabric obtained in the above (2) was pierced to thereby form penetrating openings of 15 mm in diameter (opening area: about 177 mm$^2$) at a ratio of 16 openings/100 cm (the ratio of the total opening area: 28%, the minimum distance between adjacent openings: 8 mm) to thereby give a fabric for plant life.

(4) When measured by the method as specified above, the fabric for plant life obtained in the above (3) showed an apparent density under elevated pressure of 20 g/cm$^2$ of 0.3 g/cm$^3$. The thickness of the fabric for plant life under elevated pressure of 20 g/cm$^2$ was 2 mm. The moisture absorbing capacity of the fabric for plant life was 0.49 g water/cm$^3$. Further, the moisture absorbing capacity $Q_1$ of the moisture-absorbent polymer after the adhesion to the fiber determined by the above-mentioned method was $0.017Q_0$. The average fiber intersection distance thereof was 0.2 mm.

Example 5

(1) A knit fabric with the knit structure as shown in FIG. 4 having a Metsuke of 190 g/m$^2$ was produced by using a polyester filament yarn having a fineness of 200 dr (diameter: 143 μm) by using a double-raschel knitting machine.

(2) A moisture-absorbent polymer solution was prepared by mixing 100 parts by weight of a vinyl alcohol/sodium acrylate copolymer having a moisture absorbing capacity $Q_0$ of about 367 times as much as its dry weight (a moisture-absorbent polymer; IGETAGEL P, manufactured by SUMITOMO SEIKA CHEMICALS CO., LTD.) and 100 parts by weight of an urethane polymer (a binder polymer; CRISVON 6306B, manufactured by DAINIPPON INK & CHEMICALS INC., solid content: 30% by weight). Then the knit fabric produced in the above (1) was immersed in this moisture-absorbent polymer solution. After taking out, the knit fabric was squeezed under squeezing pressure of 1.2 kg·f/cm$^2$ to thereby eliminate the excessive moisture-absorbent polymer solution therefrom and dried at 120° C. to thereby give a fabric for plant life made of the knit fabric with a Metsuke of 300 g/m$^2$ to which 110 g/m$^2$ in total of the moisture-absorbent polymer and the binder polymer had been adhered. This fabric for plant life had a thickness of 5.3 mm (=height of the surrounding walls around the penetrating openings).

(3) When measured by the method as specified above, the moisture-absorbent fabric for plant life made of the knit fabric obtained in the above (2) showed an apparent density under elevated pressure of 20 g/cm$^2$ of 0.065 g/cm$^3$. The thickness of the fabric for plant life under elevated pressure of 20 g/cm$^2$ was 4.6 mm. The moisture absorbing capacity of the fabric for plant life was 1.0 g water/cm$^3$. Further, opening area of square penetrating openings formed due to the knit structure of this fabric for plant life was 64 mm$^2$. When determined by the above-mentioned method, the moisture absorbing capacity $Q_1$ of the moisture-absorbent polymer after the adhesion to the fiber was $0.07Q_0$.

Example 6

(1) A knit fabric with the knit structure as shown in FIG. 4 having a Metsuke of 215 g/m$^2$ was produced by using a polyester filament yarn having a fineness of 200 dr (diameter: 143 μm) by using a double-raschel knitting machine.

(2) A moisture-absorbent polymer solution was prepared by mixing 100 parts by weight of a vinyl alcohol/sodium acrylate copolymer having a moisture absorbing capacity $Q_0$ of about 367 times as much as its dry weight (a moisture-absorbent polymer; IGETAGEL P, manufactured by SUMITOMO SEIKA CHEMICALS CO., LTD.) and 800 parts by weight of an urethane polymer (a binder polymer; CRISVON 6306B, manufactured by DAINIPPON INK & CHEMICALS INC., solid content: 30% by weight). Then the knit fabric produced in the above (1) was immersed in this moisture-absorbent polymer solution. After taking out, the knit fabric was squeezed under squeezing pressure of 1.2 kg·f/cm$^2$ to thereby eliminate the excessive moisture-absorbent polymer solution therefrom and dried at 120° C. to thereby give a fabric for plant life made of the knit fabric with a Metsuke of 300 g/m$^2$ to which 85 g/m$^2$ in total of the moisture-absorbent polymer and the binder polymer had been adhered. This fabric for plant life had a thickness of 5.3 mm (=height of the surrounding walls around the penetrating openings).

(3) When measured by the method as specified above, the moisture-absorbent fabric for plant life made of the knit fabric obtained in the above (2) showed an apparent density under elevated pressure of 20 g/cm$^2$ of 0.065 g/cm$^3$. The thickness of the fabric for plant life under elevated pressure of 20 g/cm$^2$ was 4.6 mm. The moisture absorbing capacity of the fabric for plant life was 0.04 g water/cm$^3$. Further, opening area of square penetrating openings formed due to the knit structure of this fabric for plant life was 64 mm$^2$. When determined by the above-mentioned method, the moisture absorbing capacity $Q_1$ of the moisture-absorbent polymer after the adhesion to the fiber was $0.02Q_0$.

Example 7

(1) A knit fabric with the knit structure as shown in FIG. 4 having a Metsuke of 120 g/m$^2$ was produced by using a polyester filament yarn having a fineness of 200 dr (diameter: 143 μm) by using a double-raschel knitting machine.

(2) A moisture-absorbent polymer solution was prepared by mixing 200 parts by weight of a polyacrylic acid resin having a moisture absorbing capacity $Q_0$ of about 650 times as much as its dry weight (a moisture-absorbent polymer; ARASOAP G, manufactured by ARAKAWA CHEMICALS CO., LTD.) and 100 parts by weight of an urethane polymer (a binder polymer; CRISVON 6306B, manufactured by DAINIPPON INK & CHEMICALS INC., solid content: 30% by weight). Then the knit fabric produced in the above (1) was immersed in this moisture-absorbent polymer solution. After taking out, the knit fabric was squeezed under squeezing pressure of 1.2 kg·f/cm$^2$ to thereby eliminate the excessive moisture-absorbent polymer solution therefrom and dried at 120° C. to thereby give a fabric for plant life made of the knit fabric with a Metsuke of 300 g/m$^2$ to which 180 g/m$^2$ in total of the moisture-absorbent polymer and the binder polymer had been adhered. This fabric for plant life had a thickness of 5.3 mm (=height of the surrounding walls around the penetrating openings).

(3) When measured by the method as specified above, the moisture-absorbent fabric for plant life made of the knit fabric obtained in the above (2) showed an apparent density under elevated pressure of 20 g/cm$^2$ of 0.2 g/cm$^3$. The thickness of the fabric for plant life under elevated pressure of 20 g/cm$^2$ was 4.6 mm. The moisture absorbing capacity of the fabric for plant life was 8.3 g water/cm$^3$. Further, opening area of square penetrating openings formed due to the knit structure of this fabric for plant life was 64 mm$^2$. When determined by the above-mentioned method, the moisture absorbing capacity $Q_1$ of the moisture-absorbent polymer after the adhesion to the fiber was $0.37Q_0$.

Comparative Example 1

(1) A nonwoven fabric was produced by using a polyester fiber having a fineness of 20 dr (diameter: 45 μm) by the needle-punching method in a conventional manner. To improve the strength of the nonwoven fabric, an acrylic resin (DICNARL E-8290, manufactured by DAINIPPON INK & CHEMICALS INC.) was adhered thereto at a ratio of 5% by weight based on the fiber weight to thereby give an acrylic resin-treated nonwoven fabric with a Metsuke of 480 g/m$^2$.

(2) The same moisture-absorbent polymer solution as the one employed in Example 2 (2) was adhered to the acrylic resin-treated nonwoven fabric produced in the above (1) by spraying thereto and dried at 120° C. to thereby give a fabric for plant life made of the nonwoven fabric with a Metsuke of 630 g/m$^2$ to which 150 g/m$^2$ in total of the moisture-absorbent polymer and the binder polymer had been adhered. This fabric for plant life had a thickness of 1.6 mm.

(3) When measured by the method as specified above, the moisture-absorbent fabric for plant life made of the fabric for plant life obtained in the above (2) showed an apparent density under elevated pressure of 20 g/cm$^2$ of 0.45 g/cm$^3$. The thickness of the fabric for plant life under elevated pressure of 20 g/cm$^2$ was 1.4 mm. The moisture absorbing capacity of the fabric for plant life was 4.3 g water/cm$^3$. Further, the moisture absorbing capacity $Q_1$ of the moisture-absorbent polymer after the adhesion to the fiber determined by the above-mentioned method was $0.09Q_0$. The opening areas of the penetrating openings due to the nonwoven texture ranged from about 0.0004 to 0.01 mm$^2$ and the average fiber intersection distance thereof was 0.06 mm.

Comparative Example 2

(1) A plain weave fabric having a Metsuke of 100 g/m$^2$ was produced in a conventional manner by using the same polyester filament yarn as the one employed in Example 5 having a fineness of 200 dr (diameter: 143 μm).

(2) Then the plain weave fabric produced in the above (1) was immersed in the same moisture-absorbent polymer solution as the one employed in Example 5 (2). After taking out, the fabric was squeezed under squeezing pressure of 2 kg·f/cm$^2$ to thereby eliminate the excessive moisture-absorbent polymer solution therefrom and dried at 120° C. to thereby give a moisture-absorbent fabric for plant life made of the fabric with a Metsuke of 150 g/m$^2$ to which 50 g/m$^2$ in total of the moisture-absorbent polymer and the binder polymer had been adhered. This fabric for plant life had a thickness of 0.7 mm.

(3) Because of being thin, 5 test pieces (50 cm×50 cm) of the fabric for plant life made of the fabric obtained in the above (2) were laid one on the top of another and then the apparent density was measured under elevated pressure of 20 g/cm$^2$ by the above-mentioned method. Thus it showed an apparent density of 0.21 g/cm$^3$. The moisture absorbing capacity of the fabric for plant life was 8.5 g water/cm$^3$. When determined by the above-mentioned method, the moisture absorbing capacity $Q_1$ of the moisture-absorbent polymer after the adhesion to the fiber was $0.42Q_0$.

Comparative Example 3

A mesh sheet of a Metsuke of 75 g/m$^2$ was produced by using a yarn corresponding to 2000 dr obtained by mixing a modified acrylic fiber which is swelled when absorbing water with cotton at a ratio of 7.5:1.

Comparative Example 4

(1) A nonwoven fabric was produced by using a polypropylene fiber having a fineness of 20 dr (diameter: 45 μm) by the span-bonding method in a conventional manner. To improve the strength of the nonwoven fabric, an acrylic resin (DICNARL E-8290, manufactured by DAINIPPON INK & CHEMICALS INC.) was adhered thereto at a ratio of 5% by weight based on the fiber weight to thereby give an acrylic resin-treated nonwoven fabric with a Metsuke of 30 g/m$^2$.

(2) The same moisture-absorbent polymer solution as the one employed in Example 1 (2) was adhered to the acrylic resin-treated nonwoven fabric produced in the above (1) by the method similar to Example 1 (2) thereto and dried at 120° C. to thereby give a fabric for plant life made of the nonwoven fabric with a Metsuke of 40 g/m$^2$ to which 10 g/m$^2$ in total of the moisture-absorbent polymer and the binder polymer had been adhered. This fabric for plant life had a thickness of 0.35 mm.

(3) When measured by the method as specified above, the moisture-absorbent fabric for plant life made of the fabric for plant life obtained in the above (2) showed an apparent density under elevated pressure of 20 g/cm$^2$ of 0.13 g/cm$^3$. The thickness of the fabric for plant life under elevated pressure of 20 g/cm$^2$ was 0.3 mm. The moisture absorbing capacity of the fabric for plant life was 0.057 g water/cm$^3$. Further, the moisture absorbing capacity $Q_1$ of the moisture-absorbent polymer after the adhesion to the fiber determined by the above-mentioned method was $0.19Q_0$. The opening areas of the penetrating openings due to the nonwoven texture ranged from about 0.001 to 0.04 mm$^2$ and the average fiber intersection distance thereof was 0.11 mm.

Turf and Watermelon Growth Tests (1) The fabrics for use with plant life obtained in the above Examples and Comparative Examples were each cut into pieces (100 cm×100 cm) and buried in the soil in a depth of 30 cm. After covering with soil in a depth of 10 cm, turf seeds were planted at a ratio of 30 g/m$^2$ almost regularly. Also, watermelon seeds were planted at a ratio of 4 seeds/m$^2$ at intervals of 50 cm on the fabrics for use with plant life buried in the same manner to thereby give samples for evaluating the growth states. For comparison, the above procedures were repeated but using no fabric for plant life.

(2) The samples prepared in the above (1) were placed in a test room at a temperature of 45° C. under a humidity of 10% and fed with 10 l/m$^2$ of water thrice per day (i.e., every 8 hours) until germination. After germination, these plants were fed with 20 l/m$^2$ of water once a day and the growth states were evaluated in accordance with the following criteria. Table 2 shows the results. The feeding water employed in this test was one containing 3000 ppm of sodium chloride, on the assumption that desalinated seawater might be used.

TABLE 1

Criteria for evaluating the growth state of turf or watermelon

| LEVEL | GROWTH STATE |
|---|---|
| 1 | very well growth, showing a fresh green color without any withering or wilting. |
| 2 | well growth, being not so lively but showing a rather green color. |
| 3 | somewhat poor growth, being not lively, not withering but some wilting. |
| 4 | poor growth, withering. |
| 5 | seriously poor growth, mostly turning to yellow and withering. |
| 6 | no growth, almost completely turning to yellow and withering. |

TABLE 2

| | Ex. 1 | Ex. 2 | Ex. 3 | Ex. 4 | Ex. 5 | Ex. 6 | Ex. 7 |
|---|---|---|---|---|---|---|---|
| Fabric form | non woven | non woven | non woven | non woven | knit | knit | knit |
| Fineness (dr)/content (%) of thick fiber | 100/100 | 100/70 | 35/50 | 200/20 | 200/100 | 200/100 | 200/100 |
| Other fiber [size (dr)/content (%)] | —/0 | 20/30 | 25/50 | 25/80 | —/0 | —/0 | —/0 |
| Apparent density (g/cm$^3$) | 0.081 | 0.12 | 0.03 | 0.3 | 0.065 | 0.065 | 0.065 |
| Thickness (mm) | 3.7 | 2.5 | 5 | 2 | 4.6 | 4.6 | 4.6 |
| Moisture-absorbent polymer: binder polymer | 2:1 | 1:1 | 1:1 | 1:1 | 10:3 | 1:2.4 | 10:1.5 |
| Moisture retention characteristics of moisture-absorbent polymer:$Q_0$ (times) | 140 | 286 | 286 | 286 | 367 | 367 | 650 |
| Moisture retention characteristics of fabric (g water/cm$^3$) | 1.4 | 2.0 | 0.5 | 0.49 | 1.0 | 0.04 | 8.3 |
| Moisture retention characteristics of moisture-absorbent polymer after adhesion:$Q_1$ | 0.05 $Q_0$ | 0.08 $Q_0$ | 0.35 $Q_0$ | 0.017 $Q_0$ | 0.07 $Q_0$ | 0.02 $Q_0$ | 0.37 $Q_0$ |
| Turf growth test: germination time (days after sowing) | 7 | 9 | 10 | 8 | 8 | 9 | 7 |
| Growth state (level; after germination): | | | | | | | |
| 1 week | 1 | 1 | 1 | 1 | 1 | 1 | 1 |
| 3 weeks | 1 | 1 | 1 | 1 | 1 | 1 | 1 |
| 5 weeks | 1 | 1 | 1 | 1 | 1 | 1 | 1 |
| 8 weeks | 1 | 1 | 1 | 1 | 1 | 1 | 1 |
| Watermelon growth test: germination time (days after sowing) | 18 | 20 | 21 | 19 | 18 | 19 | 18 |
| Growth state | | | | | | | |

TABLE 2-continued

| | | | | | | | |
|---|---|---|---|---|---|---|---|
| (level; after germination): | | | | | | | |
| 1 week | 1 | 1 | 1 | 1 | 1 | 1 | 1 |
| 3 weeks | 1 | 1 | 1 | 1 | 1 | 1 | 1 |
| 5 weeks | 1 | 1 | 1 | 1 | 1 | 1 | 1 |
| 8 weeks | 1 | 1 | 1 | 1 | 1 | 1 | 1 |

| | C. Ex. 1 | C. Ex. 2 | C. Ex. 3 | C. Ex. 4 | Ref. |
|---|---|---|---|---|---|
| Fabric form | non woven | plain weave | mesh sheet | non woven | (no fabric) |
| Fineness (dr)/content (%) of thick fiber | 20/100 | 200/100 | — | 20/100 | — |
| Other fiber [size (dr)content (%)] | —/0 | —/0 | — | — | — |
| Apparent density ($g/cm^3$) | 0.45 | 0.21 | 0.034 | 0.13 | |
| Thickness (mm) | 1.4 | 0.6 | 2.2 | 0.3 | — |
| Moisture-absorbent polymer:binder polymer | 1:1 | 10:3 | — | 2:1 | — |
| Moisture retention characteristics of moisture-absorbent polymer:$Q_0$ (times) | 286 | 367 | — | 140 | — |
| Moisture retention characteristics of fabric (g water/$cm^3$) | 4.3 | 8.5 | 4.2 | 0.057 | — |
| Moisture retention characteristics of moisture-absorbent polymer after adhesion:$Q_1$ | 0.09 $Q_0$ | 0.42 $Q_0$ | — | 0.19 $Q_0$ | — |
| Turf growth test: germination time (days after sowing) | 11 | 11 | 11 | 11 | 12 |
| Growth state (level; after germination): | | | | | |
| 1 week | 1 | 2 | 1 | 2 | 5 |
| 3 weeks | 1 | 3 | 2 | 3 | 6 |
| 5 weeks | 2 | 4 | 3 | 4 | *1 |
| 8 weeks | 3 | 5 | 4 | 5 | *1 |
| Watermelon growth test: germination time (days after sowing) | 23 | 23 | 23 | 23 | 25 |
| Growth state (level; after germination): | | | | | |
| 1 week | 1 | 2 | 2 | 3 | 4 |
| 3 weeks | 2 | 3 | 2 | 3 | 5 |
| 5 weeks | 3 | 3 | 3 | 4 | 6 |
| 8 weeks | 3 | 4 | 4 | 5 | *1 |

*1) The observation on the growth state was stopped due to withering.

The results given in Table 2 indicate that turf and watermelon could be well raised by using the fabric for plant life of the present invention which contained at least 5% by weight of an organic polymer fiber having a fineness of at least 30 deniers, showed an apparent density of from 0.001 to 0.3 $g/cm^3$ under elevated pressure of 20 $g/cm^2$, and had a thickness of at least 2 mm without elevated pressure.

In contrast thereto, turf and watermelon could not well grow when a moisture-absorbent fabric for plant life showing an apparent density exceeding 0.3 $g/cm^3$ under elevated pressure of 20 $g/cm^2$ obtained by using an organic polymer fiber having a fineness of 20 dr, and a fabric for plant life made of a moisture-absorbent plain weave fabric having a thickness of less than 2 mm, or a knit mesh sheet consisting of a moisture-absorbent fiber was employed.

The fabric for plant life of the present invention sustains excellent moisture retention characteristics and appropriate drainage characteristics and has an appropriate space (voids) allowing the healthy growth of plant roots. Further, harmful substances contained in water such as salts are hardly accumulated in the fabric for plant life of the present invention. Moreover, these harmful substances accumulated therein, if any, can be easily eliminated by supplying water in excess thereto. By using the fabric for plant life of the present invention, therefore, plants can well grow with scarcely any troubles such as withering due to a shortage of water, root rot due to excessive water content, poor growth or withering due to close rooting, salinization, etc. By taking advantage of these characteristics, the fabric for plant life of the present invention can be very efficiently employed for raising plants in, for example, areas with extremely little rainfall (deserts, etc.), areas where rainwater can be scarcely retained in the ground (slopes, etc.), and areas where considerable labor and a long time are needed for feeding water (golf courses, soccer stadiums, baseball grounds, median strips, etc.).

What is claimed is:

1. A fabric for plant life comprising:

fibrous material containing not less than 5% by weight of an organic polymer fiber having a fineness of not less than 30 deniers;

a moisture-absorbent polymer; and a binder polymer, said moisture-absorbent polymer and said binder polymer being adhered to said fibrous material;

wherein said fabric has a water absorption per volume of from 0.02 to 10 g water/$cm^3$, shows an apparent density of from 0.001 to 0.3 g/$cm^3$ under elevated pressure of 20 g/$cm^2$, and has a thickness of not less than 2.0 mm.

2. The fabric for plant life as claimed in claim 1, wherein said fabric is in the form of a nonwoven fabric.

3. The fabric for plant life as claimed in claim 1, wherein the weight ratio of said moisture-absorbent polymer to said binder polymer is from 1:3 to 10:1.

4. The fabric for plant life as claimed in claim 1, wherein said moisture-absorbent polymer absorbs moisture of 10 to 1,000 times as much as its own dry weight and, after the adhesion to the fiber, the moisture absorbing capacity of said moisture-absorbent polymer is apparently reduced, due to the coexistence of said binder polymer, so as to satisfy the formula of $0.01Q_0 \leqq Q_1 \leqq 0.5Q_0$, where $Q_0$ means the inherent moisture absorbing capacity of the moisture-absorbent polymer observed prior to the adhesion thereof to said organic polymer fiber, and $Q_1$ represents the apparent moisture absorbing capacity of the moisture-absorbent polymer observed after the adhesion thereof to the organic polymer fiber.

5. The fabric for plant life as claimed in claim 1, having openings of from 0.5 to 750 $mm^2$ in opening area penetrating through the fabric in the direction of depth of the same.

6. The fabric for plant life as claimed in claim 1, wherein the content of said organic polymer fiber is not less than 20% by weight.

7. The fabric for plant life as claimed in claim 6, wherein the content of said organic polymer fiber is in the range of 50 to 100 by weight.

8. The fabric for plant life as claimed in claim 1, wherein the fineness of said organic polymer is not more than 300 deniers.

9. The fabric for plant life as claimed in claim 1, wherein the apparent density of said fabric is from 0.002 to 0.2 g/$cm^3$ under elevated pressure of 20 g/$cm^2$.

10. The fabric for plant life as claimed in claim 1, wherein the thickness of said fabric is 2 to 50 mm.

11. The fabric for plant life as claimed in claim 1, wherein the thickness of said fabric is not less than 1.5 mm under elevated pressure of 20 g/$cm^2$.

12. The fabric for plant life as claimed in claim 1, wherein an average fiber intersection distance of said fibrous material is in the range of 0.2 to 4 mm.

13. A method comprising raising plants in the presence of a fabric for plant life, said fabric comprising:

fibrous material which contains not less than 5% by weight of an organic polymer fiber having a fineness of not less than 30 deniers;

a moisture-absorbent polymer; and a binder polymer, said moisture-absorbent polymer and said binder polymer being adhered to said fibrous material;

wherein said fabric has a water absorption per volume of from 0.02 to 10 g water/$cm^3$, shows an apparent density of from 0.001 to 0.3 g/$cm^3$ under elevated pressure of 20 g/$cm^2$ and has a thickness of not less than 1.5 mm under elevated pressure of 20 g/$cm^2$.

14. The method as claimed in claim 13, wherein said fabric is in the form of a nonwoven fabric.

15. The method as claimed in claim 13, wherein the weight ratio of said moisture-absorbent polymer to said binder polymer is from 1:3 to 10:1.

16. The method for raising plants by using a fabric for plant life as claimed in claim 13, wherein said moisture-absorbent polymer absorbs moisture of 10 to 1,000 times as much as its own dry weight and, after the adhesion to the fiber, the moisture absorbing capacity of said moisture-absorbent polymer is apparently reduced, due to the coexistence of said binder polymer, so as to satisfy the formula of $0.01Q_0 \leqq Q_1 \leqq 0.5Q_0$, where $Q_0$ means the inherent moisture absorbing capacity of the moisture-absorbent polymer observed prior to the adhesion thereof to said organic polymer fiber, and $Q_1$ represents the apparent moisture absorbing capacity of the moisture-absorbent polymer observed after the adhesion thereof to the organic polymer fiber.

17. The fabric for plant life as claimed in claim 4, wherein said moisture-absorbent polymer absorbs moisture of about 30 to 1,000 times as much of its own dry weight.

18. The fabric for plant life as claimed in claim 17, wherein said moisture-absorbent polymer absorbs moisture of about 100 to 1,000 times as much of its own dry weight.

19. The method as claimed in claim 16, wherein said moisture-absorbent polymer absorbs moisture of about 30 to 1,000 times as much of its own dry weight.

20. The method as claimed in claim 19, wherein said moisture-absorbent polymer absorbs moisture of about 100 to 1,000 times as much of its own dry weight.

* * * * *